US012565394B2

(12) United States Patent
Sasaki et al.

(10) Patent No.: US 12,565,394 B2
(45) Date of Patent: Mar. 3, 2026

(54) FEED ROLLER MECHANISM AND PRINTER

(71) Applicant: SATO HOLDINGS KABUSHIKI KAISHA, Tokyo (JP)

(72) Inventors: Shuzo Sasaki, Minato-ku (JP); Hidemichi Oyama, Minato-ku (JP)

(73) Assignee: SATO CORPORATION, Tokyo (JP)

( * ) Notice: Subject to any disclaimer, the term of this patent is extended or adjusted under 35 U.S.C. 154(b) by 137 days.

(21) Appl. No.: 18/561,426

(22) PCT Filed: May 27, 2022

(86) PCT No.: PCT/JP2022/021775
§ 371 (c)(1),
(2) Date: Nov. 16, 2023

(87) PCT Pub. No.: WO2022/255260
PCT Pub. Date: Dec. 8, 2022

(65) Prior Publication Data

US 2024/0239621 A1 Jul. 18, 2024

(30) Foreign Application Priority Data

May 31, 2021 (JP) ..... 2021-091670

(51) Int. Cl.
*B65H 23/16* (2006.01)
*B65H 20/02* (2006.01)

(52) U.S. Cl.
CPC ..... *B65H 23/16* (2013.01); *B65H 20/02* (2013.01); *B65H 2301/44318* (2013.01); *B65H 2402/54* (2013.01); *B65H 2404/142* (2013.01); *B65H 2515/30* (2013.01); *B65H 2701/192* (2013.01); *B65H 2801/12* (2013.01)

(58) Field of Classification Search
CPC ..... B65H 23/16; B65H 20/02
See application file for complete search history.

(56) References Cited

U.S. PATENT DOCUMENTS

| | | | | |
|---|---|---|---|---|
| 8,348,268 | B2 * | 1/2013 | Urban | B65H 5/38 271/272 |
| 8,587,848 | B2 | 11/2013 | Nose et al. | |
| 2008/0230975 | A1 | 9/2008 | Matsuzuki et al. | |
| 2010/0001461 | A1 * | 1/2010 | Takeshita | B65H 5/062 271/274 |

FOREIGN PATENT DOCUMENTS

| | | | |
|---|---|---|---|
| JP | S63-113030 | U | 7/1988 |
| JP | 2001-139179 | A | 5/2001 |
| JP | 2015-223704 | A | 12/2015 |
| WO | WO-03/010080 | A1 | 2/2003 |

* cited by examiner

*Primary Examiner* — Patrick Cicchino
(74) *Attorney, Agent, or Firm* — Foley & Lardner LLP

(57) ABSTRACT

A feed roller mechanism that feeds a continuous paper while nipping the continuous paper between a first roller and a second roller that face each other, the feed roller mechanism includes a plate-shaped first support member that supports the first roller, and a plate-shaped second support member that supports the first support member, wherein the first roller nips the continuous paper with the second roller by a deflection reaction force of the first support member.

6 Claims, 8 Drawing Sheets

FEED ROLLER MECHANISM AND PRINTER

TECHNICAL FIELD

The present invention relates to a feed roller mechanism and a printer.

BACKGROUND ART

JP2015-223704A discloses a printer provided with a liner sheet pulling roller that feeds a liner sheet of a label continuous body that is turned by a peeling plate rearward while nipping the liner sheet with an opposing roller.

SUMMARY OF INVENTION

In a mechanism that feeds a continuous paper using two rollers, such as the printer described above, it is required that the two rollers have an appropriate nipping force for nipping the continuous paper.

For example, when the nipping force between the two rollers becomes excessively high due to an assembly error or the like, it is considered that slippage between the two rollers and the continuous paper becomes difficult to occur, so that a large tension is applied to the continuous paper being fed and the continuous paper breaks. When the slippage between the two rollers and the continuous paper is difficult to occur, it is also considered that the continuous paper is likely to be distorted, and stress concentration may cause breakage of the continuous paper.

The present invention is made in view of such technical problems, and an object thereof is to make it possible to easily set the nipping force between the two rollers to an appropriate nipping force.

According to one aspect of the present invention, a feed roller mechanism that feeds a continuous paper while nipping the continuous paper between a first roller and a second roller that face each other, the feed roller mechanism comprising: a plate-shaped first support member that supports the first roller; and a plate-shaped second support member that supports the first support member, wherein the first roller nips the continuous paper with the second roller by a deflection reaction force of the first support member.

According to the above aspect, the nipping force between the first roller and the second roller is determined by the deflection reaction force of the first support member. Therefore, it is possible to suppress variation in the nipping force due to an assembly error or the like, and it is possible to easily set the nipping force between the first roller and the second roller to an appropriate nipping force.

DESCRIPTION OF EMBODIMENTS

Hereinafter, a printer 1 provided with a feed roller mechanism 70 according to an embodiment of the present invention will be described with reference to the accompanying drawings.

Figure 1:
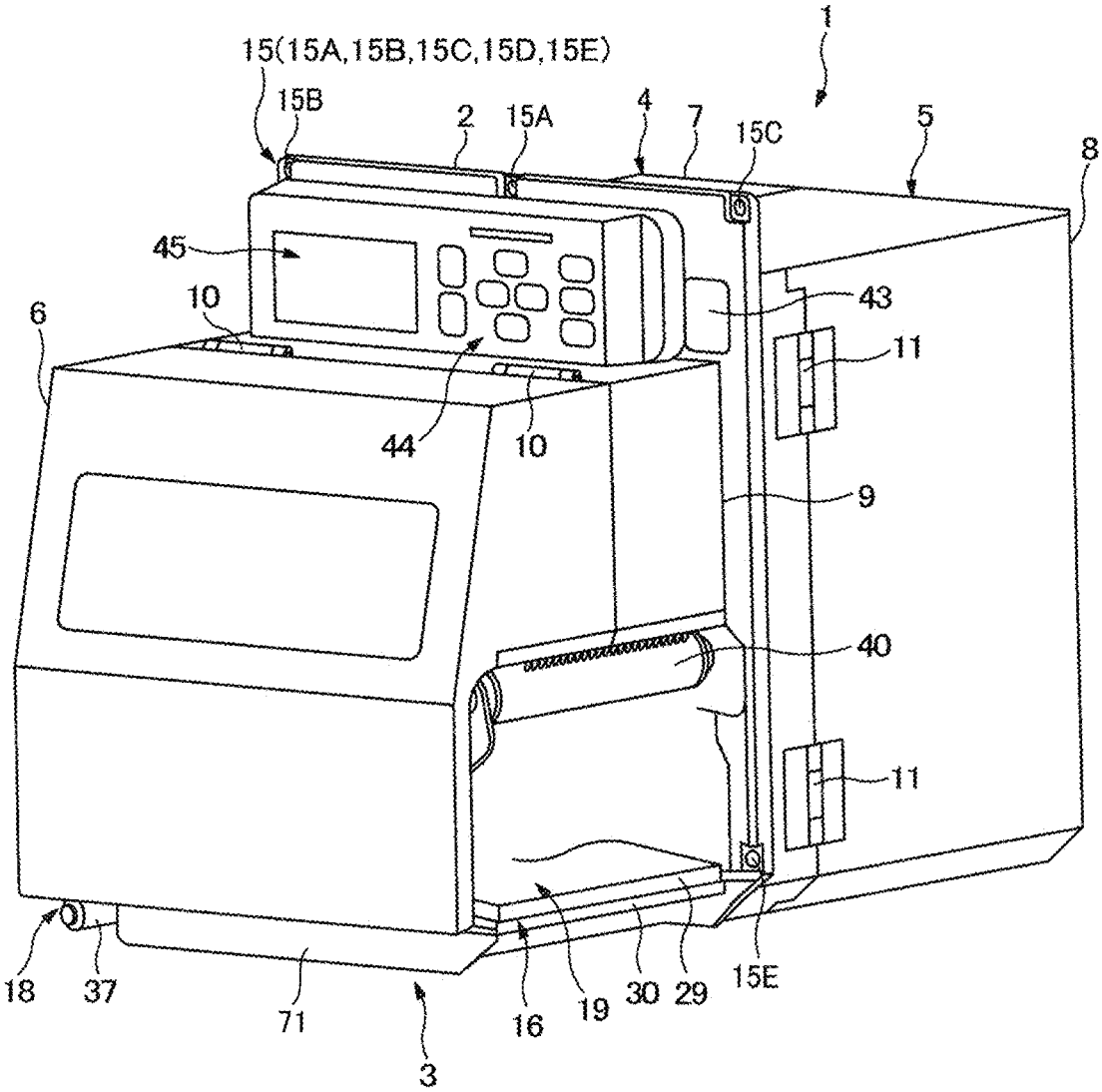
FIG. 1 is a perspective view of a printer provided with a feed roller mechanism according to an embodiment of the present invention.

FIG. 1 is a perspective view of the printer 1 provided with the feed roller mechanism 70. The printer 1 includes a central main body unit 2, a printing unit 3, a drive unit (not shown) that drives the printing unit 3, a control unit 4, and a power supply unit 5. The printing unit 3 is positioned on one side surface (a front surface) of the central main body unit 2. The drive unit, the control unit 4, and the power supply unit 5 are positioned on the other (opposite) side surface (a back surface) of the central main body unit 2.

Figure 2:
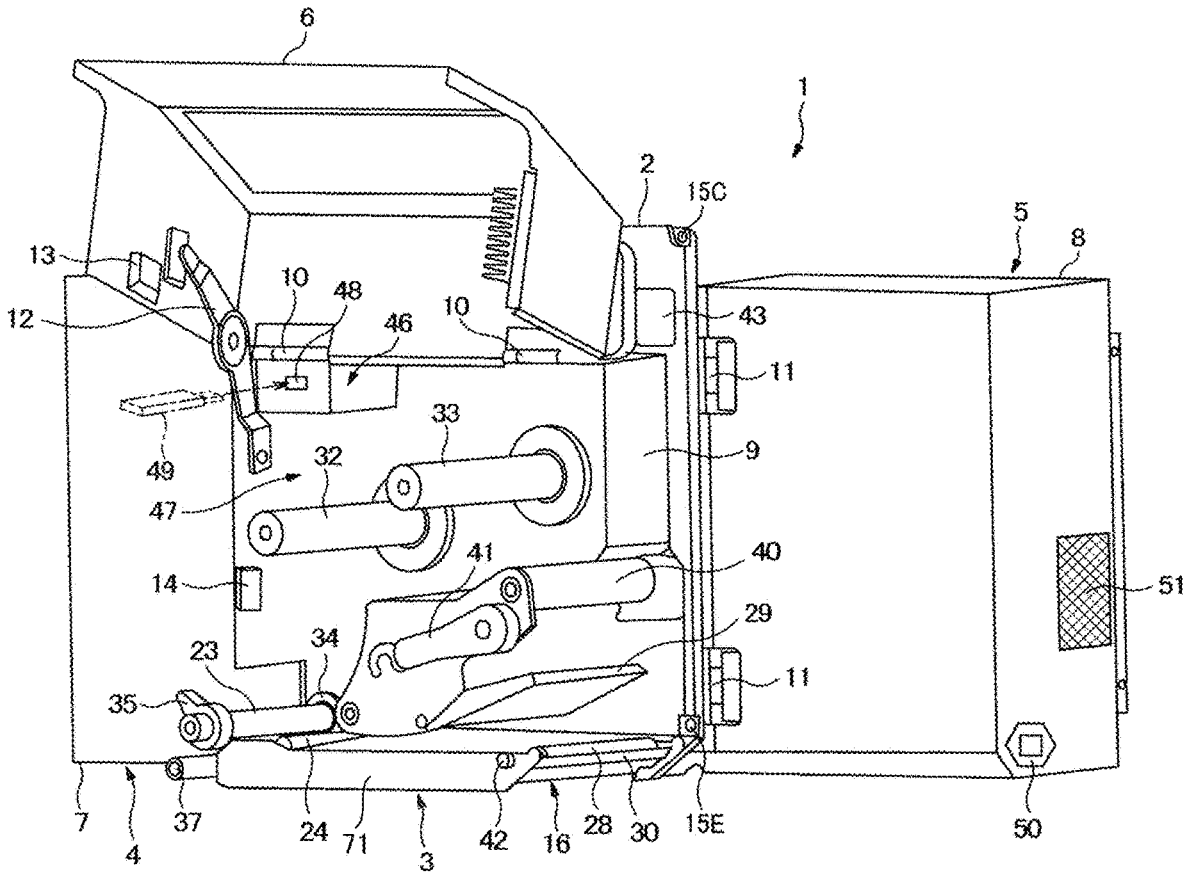
FIG. 2 is a perspective view of the printer with a printing unit cover, a control unit cover, and a power supply unit cover opened.

FIG. 2 is a perspective view of the printer 1 with a printing unit cover 6, a control unit cover 7, and a power supply unit cover 8 opened.

The printing unit cover 6 can be opened and closed around a printing unit cover opening and closing shaft 10 provided in a support case 9 of the central main body unit 2.

The control unit cover 7 can be opened and closed around a control unit cover opening and closing shaft (not shown) provided at one end portion of the central main body unit 2.

The power supply unit cover 8 can be opened and closed around a power unit cover opening and closing shaft 11 provided at the other end portion of the central main body unit 2.

A support link 12 is provided between the printing unit cover 6 and the support case 9 in a manner of bending as the printing unit cover 6 opens and closes. As a result, an open state of the printing unit cover 6 can be maintained. By providing a cover-side magnet 13 and a case-side magnet 14, a closed state of the printing unit cover 6 can also be maintained.

The central main body unit 2 is a rectangular plate-like unit having a predetermined mechanical strength. The central main body unit 2 is positioned at a central portion of the printer 1, and assembled with the printing unit 3, the drive unit (not shown), the control unit 4, and the power supply unit 5.

Figure 3:
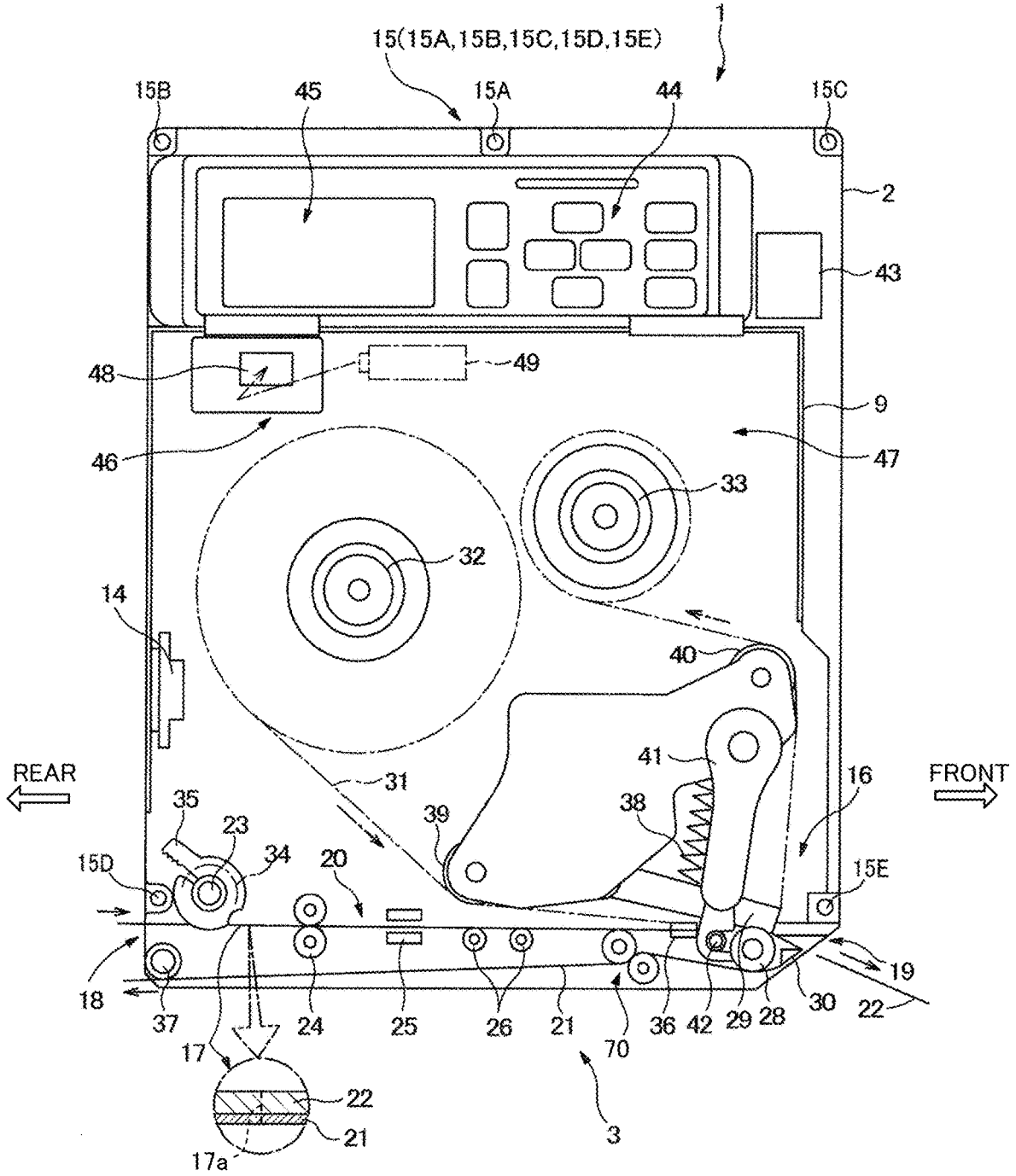
FIG. 3 is a front view of the printer with the printing unit cover removed.

FIG. 3 is a front view of the printer 1 from which the printing unit cover 6 is removed.

The central main body unit 2 is provided with a mounting portion 15 for mounting the printer 1 to a labeling machine (not shown).

The mounting portion 15 may have any configuration, and is provided at a peripheral portion of the central main body unit 2 in the example shown in FIG. 3. Specifically, the mounting portion 15 according to the present embodiment includes five mounting holes (an upper central mounting hole 15A, an upper left end mounting hole 15B, an upper right end mounting hole 15C, a lower left end mounting hole 15D, and a lower right end mounting hole 15E) formed on the peripheral portion of the central main body unit 2.

The printing unit 3 includes a printing section 16 that prints on a printing paper sheet (for example, a label or a label continuous body).

When the printing unit cover 6 is set to the open state, the printing section 16 of the printing unit 3 is exposed to the outside.

The printing unit 3 can print predetermined information on a label continuous body 17 in a feeding path 20 from an introduction port 18 to a discharge port 19 of the label continuous body 17 (printing paper sheet).

As shown in an enlarged cross section in FIG. 3, the label continuous body 17 includes a strip-shaped liner sheet 21 as a continuous paper, and a plurality of labels 22 temporarily attached to the liner sheet 21. A position detection mark (not shown) is printed in advance on a back surface side of the liner sheet 21.

As shown in FIG. 3, the label continuous body 17 may be a fanfold label or a roll label including perforations 17*a* formed at a predetermined interval, or a roll label including no perforations 17*a*. The perforations 17*a* may be provided in a manner of penetrating the labels 22 and the liner sheet 21, or may be provided only on the liner sheet 21. The label continuous body 17 may have a configuration in which the plurality of labels 22 are temporarily attached to the liner sheet 21 in a manner of not overlapping the perforations 17*a* provided on the liner sheet 21.

The printing section 16 includes a width regulating shaft 23, a pair of upper and lower auxiliary feed rollers 24, a position detection sensor 25, two guide rollers 26, a feed roller mechanism 70, a platen roller 28, a thermal head 29, and a peeling plate 30 in an order from an upstream side of the feeding path 20 (a rear side in FIG. 3).

The printing section 16 includes a ribbon supply shaft 32 that supplies an unused thermal transfer ink ribbon 31 between the platen roller 28 and the thermal head 29, and a ribbon roll up shaft 33 that rolls up the used thermal transfer ink ribbon 31.

As shown in FIG. 2, the width regulating shaft 23 is provided with a first width regulating fixed wall portion 34 and a width regulating movable ring 35. Positions of both left and right edge portions of the label continuous body 17 are regulated by the first width regulating fixed wall portion 34, the width regulating movable ring 35, and a second width regulating fixed wall portion 36 (see FIG. 3) provided on an upstream side of the platen roller 28. Accordingly, a feeding posture of the label continuous body 17 is appropriately regulated along the feeding path 20.

The auxiliary feed roller 24 is driven in synchronization with the platen roller 28 and assists the platen roller 28 and the thermal head 29 in feeding the label continuous body 17 in forward and reverse directions. Forward feeding is downstream feeding, and reverse transport is upstream feeding.

The position detection sensor 25 can detect a relative positional relation between the label continuous body 17 and the platen roller 28 and the thermal head 29 by detecting the position detection mark of the liner sheet 21.

The feed roller mechanism 70 feeds the liner sheet 21 turned by the peeling plate 30 to the rear side of the printer 1 (left side in FIG. 3) while nipping the liner sheet 21. The liner sheet 21 is discharged to the outside of the printer 1 via a liner sheet guide roller 37. The feed roller mechanism 70 will be described later in detail. Note that in the following description, the front side of the printer 1 is simply referred to as the "front side", and the rear side of the printer 1 is simply referred to as the "rear side".

The platen roller 28 nips the label continuous body 17 and the thermal transfer ink ribbon 31 with the thermal head 29 at a predetermined print pressure by a pressing spring 38. The printing unit 3 supplies print data to the thermal head 29 and rotates the platen roller 28 to print predetermined information on the label continuous body 17 (labels 22).

The thermal transfer ink ribbon 31 is supplied between the platen roller 28 and the thermal head 29 from the ribbon supply shaft 32 via a first ribbon guide roller 39, and is rolled up by the ribbon roll up shaft 33 via a second ribbon guide roller 40.

By pivoting an opening and closing lever 41 in a clockwise direction as shown in FIG. 2, the platen roller 28 and the thermal head 29 can be separated from each other. Accordingly, the label continuous body 17 and the thermal transfer ink ribbon 31 can be loaded between the platen roller 28 and the thermal head 29.

When the opening and closing lever 41 is pivoted in a counterclockwise direction to engage a tip portion of the opening and closing lever 41 with a lever engagement pin 42 mounted on a frame 71, the platen roller 28 and the thermal head 29 are in a printing posture shown in FIG. 3.

The peeling plate 30 turns only the liner sheet 21 of the label continuous body 17 at a tip portion thereof. Accordingly, the labels 22 are peeled off from the liner sheet 21 and discharged (issued) from the discharge port 19.

A power supply switch 43, an operation unit 44 including various operation keys, a display 45, and the like are provided above the support case 9 of the central main body unit 2 as shown in FIGS. 1 and 3.

As shown in FIGS. 2 and 3, the central main body unit 2 is provided with a non-volatile memory mounting structure 46.

The non-volatile memory mounting structure 46 includes a USB connection port 48 on the front side of the support case 9 at an upper corner of a printing section space 47 formed between the printing unit cover 6 and the central main body unit 2. A USB memory 49 can be connected to the USB connection port 48.

The USB memory 49 can store print information. With the USB memory 49 connected to the USB connection port 48, the printer 1 can execute printing on the printing paper sheet by the printing section 16. The print information is, for example, print data supplied to the control unit 4. The USB memory 49 can store various software such as various commands, application software, and firmware.

The control unit 4 controls the drive unit, the printing unit 3, and the power supply unit 5. The control unit 4 exchanges the print information with the USB memory 49 connected to the USB connection port 48 as necessary.

As shown in FIG. 2, the power supply unit 5 receives power from the outside through an outlet 50 and supplies the power to the control unit 4, the drive unit, and the printing unit 3. An air conditioning fan 51 is provided on the power supply unit cover 8.

Next, the feed roller mechanism 70 will be described.

Figure 4:
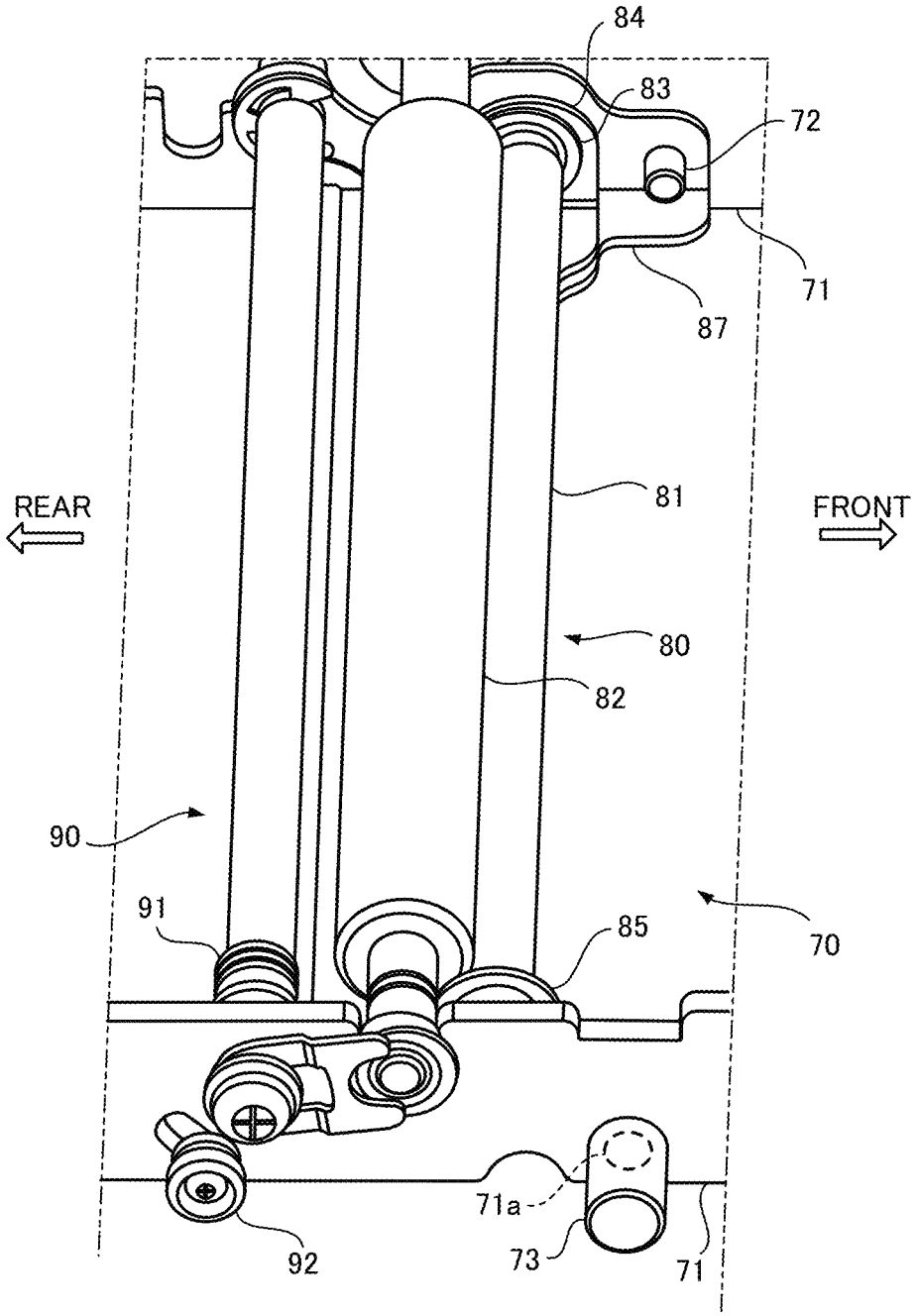
FIG. 4 is a perspective view of a periphery of the feed roller mechanism.

FIG. 4 is a perspective view of a periphery of the feed roller mechanism 70. As shown in FIG. 4, the feed roller mechanism 70 includes a roller unit 80 provided with a first roller 81, and a second roller 82. The feed roller mechanism 70 feeds the liner sheet 21 while nipping the liner sheet 21 between the first roller 81 and the second roller 82 facing each other.

The second roller 82 is supported by the frame 71 of the printing unit 3 in a rotatable manner. The second roller 82 is driven by the drive unit via a drive gear (not shown) provided at an end portion on the central main body unit 2 side. That is, the second roller 82 is a drive roller and the first roller 81 is a driven roller. A roller surface of the second roller 82 is made of a rubber material.

The roller unit 80 is attached to the frame 71 of the printing unit 3 such that the first roller 81 is pressed against the second roller 82.

Specifically, the roller unit 80 is fixed to the frame 71 through a first step of fitting a hole 87*e* (see FIG. 6) provided on a front side of the roller unit 80 to a pin 72 attached to the frame 71 from a bottom side (lower side in FIG. 3) of the printer 1, a second step of attaching a mounting screw 73 from the front side of the printer 1 to a screw hole 87*h* (see FIG. 6) provided on the front side of the roller unit 80 through a hole 71*a* of the frame 71, and a third step of locking pins 87*f* and 87*i* (see FIG. 6) provided on the rear side of the roller unit 80 to two locking portions (not shown) of the locking mechanism 90.

The locking mechanism 90 is movable between a locking position where the two locking portions lock the pins 87*f* and 87*i* and an unlocked position where the two locking portions do not lock the pins 87*f* and 87*i*, and is always biased towards the locking position by a torsion spring 91.

In the third step, when the roller unit 80 is rotated around the pin 72 and the mounting screw 73 to press the pins 87*f* and 87*i* against the two locking portions of the locking mechanism 90, the locking mechanism 90 moves to the unlocked position against the biasing force of the torsion spring 91. Then, when the roller unit 80 rotates to a predetermined mounting position, the locking mechanism 90 returns to the locking position and the pins 87*f* and 87*i* are locked by the two locking portions. In this way, the roller unit 80 is fixed to the frame 71.

When the roller unit 80 is to be removed from the printer 1, first, a release lever 92 of the locking mechanism 90 is operated to set the locking mechanism 90 to the locked position, and the locking of the pins 87*f* and 87*i* by the two locking portions is released. Next, the mounting screw 73 is removed, and finally the roller unit 80 is pulled out from the pin 72.

When the roller unit 80 is attached to the frame 71, the first roller 81 is pressed against the roller surface of the second roller 82. As a result, a nipping force for nipping the liner sheet 21 between the first roller 81 and the second roller 82 is generated.

In a mechanism that feeds a continuous paper using two rollers such as the feed roller mechanism 70, it is required that the two rollers have an appropriate nipping force for nipping the continuous paper.

For example, when the nipping force between the two rollers becomes excessively high due to an assembly error or the like, it is considered that slippage between the two rollers and the continuous paper becomes difficult to occur, so that a large tension is applied to the continuous paper being fed and the continuous paper breaks. When the slippage between the two rollers and the continuous paper is difficult to occur, it is also considered that the continuous paper is likely to be distorted, and stress concentration may cause breakage of the continuous paper.

In this regard, in the feed roller mechanism 70 of the present embodiment, the roller unit 80 is configured so that the nipping force between the first roller 81 and the second roller 82 can be easily set to an appropriate nipping force. The roller unit 80 will be described in detail below.

The roller unit 80 can change between a first setting in which the nipping force is set to a predetermined first nipping force by changing an assembly state of component parts, and a second setting in which the nipping force is set to a predetermined second nipping force that is smaller than the predetermined first nipping force.

First, the roller unit 80 in the first setting will be described.

Figure 5:
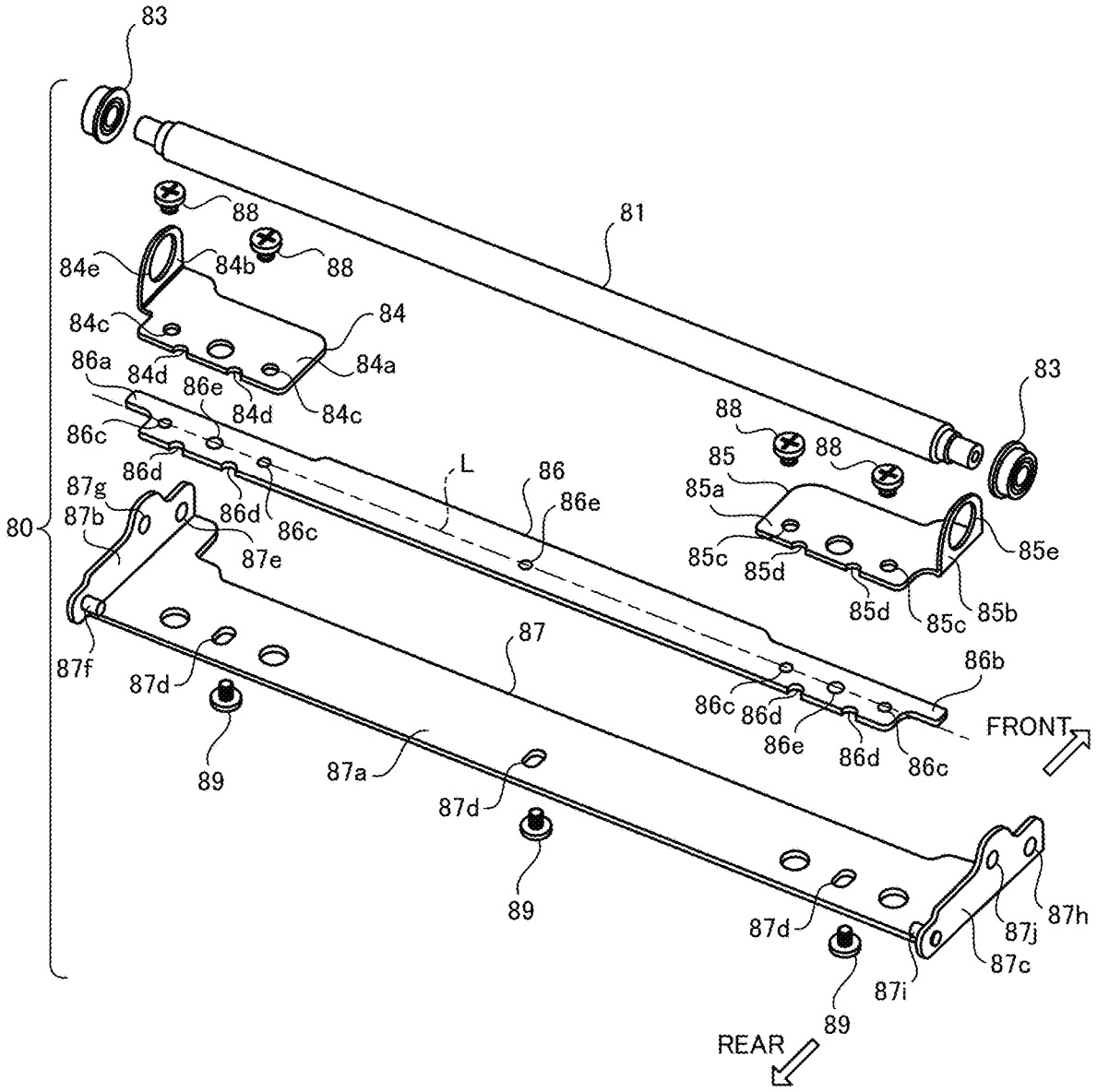
FIG. 5 is an exploded perspective view of a roller unit in a first setting.
Figure 6:
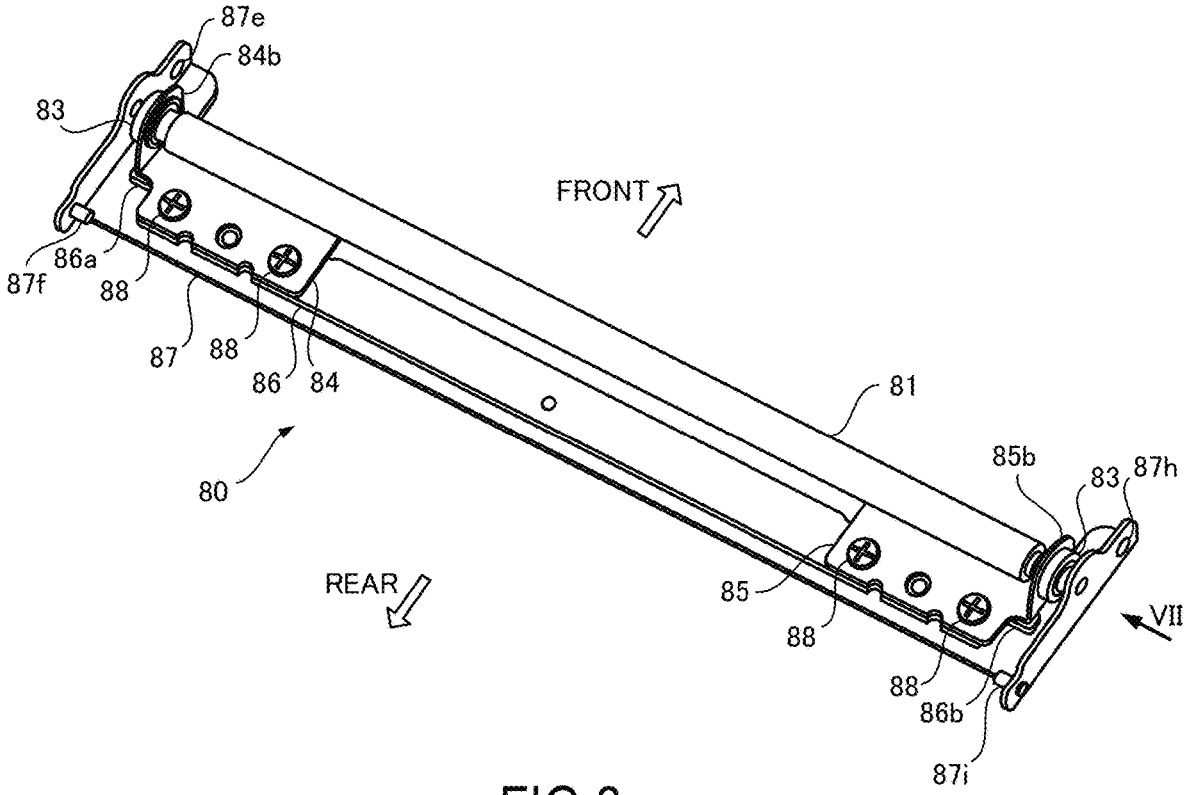
FIG. 6 is a perspective view of the roller unit in the first setting.
Figure 7:
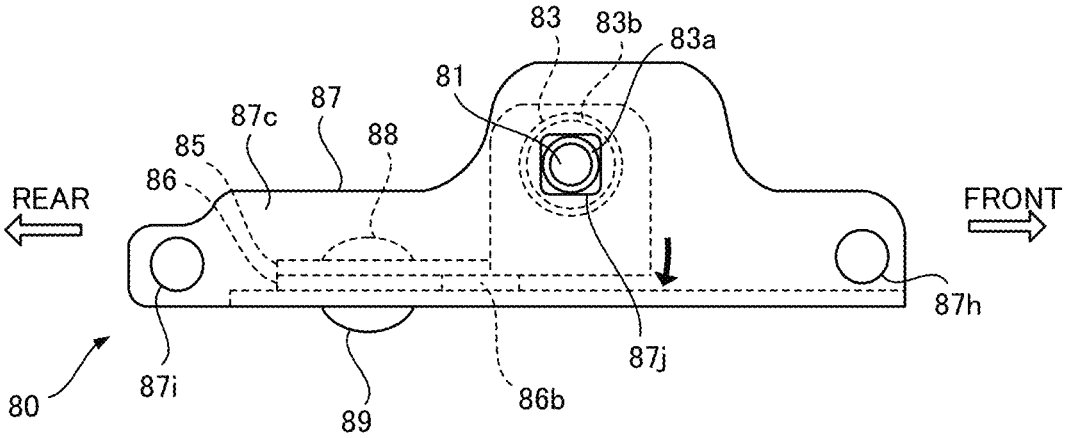
FIG. 7 is an arrow view VII of FIG. 6.

FIG. 5 is an exploded perspective view of the roller unit 80 in the first setting. FIG. 6 is a perspective view of the roller unit 80 in the first setting. FIG. 7 is an arrow view VII of FIG. 6.

As shown in FIGS. 5 and 6, the roller unit 80 includes the first roller 81, bearings 83 with flanges respectively retro-fitted on both end portions of the first roller 81; first support members 84 and 85 that support the first roller 81 via the bearings 83; a second support member 86 that supports the first support members 84 and 85; a mounting member 87 to which the second support member 86 is mounted; four screws 88 that fix the first support members 84 and 85 to the second support member 86; and three screws 89 that fix the second support member 86 to the mounting member 87. In the present embodiment, the first support member 84 and the first support member 85 are symmetrical. Therefore, the first support member 84 will be mainly described below, and description of the first support member 85 will be omitted as appropriate.

The first support members 84 and 85 are plate-like members made of metal. As shown in FIG. 5, the first support member 84 includes a base portion 84*a* and a roller support portion 84*b* formed by bending in a direction perpendicular to an axial direction of the first roller 81. As shown in FIG. 6, the axial direction of the first roller 81 in the roller unit 80 is perpendicular to the roller support portion 84*b*.

As shown in FIG. 5, the base portion 84*a* is provided with two holes 84*c* through which the screws 88 are inserted, and two notch portions 84*d* formed on rear side edges thereof. A hole 84*e* into which the bearing 83 is fitted is provided on the roller support portion 84*b*.

The two holes 84*c* are positioned on the rear side of the first support member 84, and the hole 84*e* is positioned on the front side of the first support member 84.

Similarly, the first support member 85 includes a base portion 85*a*, a roller support portion 85*b*, two holes 85*c*, two notch portions 85*d*, and a hole 85*e*.

The second support member 86 is a flat plate-like member made of metal. The second support member 86 includes a protruding portion 86*a* provided at one end portion in the axial direction of the first roller 81 and protruding in the axial direction of the first roller 81; a protruding portion 86*b* provided at the other end portion in the axial direction of the first roller 81 and protruding in the axial direction of the first roller 81; four screw holes 86*c* into which the screws 88 are screwed; four notch portions 86*d* formed on the rear side edge, and three screw holes 86*e* into which the screws 89 are screwed.

The four screw holes 86*c* and the three screw holes 86*e* are aligned on a straight line L parallel to the axial direction of the first roller 81. Positions of the protruding portions 86*a* and 86*b* are offset from the straight line L toward the front side.

The mounting member 87 is a plate-like member made of metal. The mounting member 87 includes a base portion 87*a*; a mounting portion 87*b* formed at one end portion in the axial direction of the first roller 81 by bending in the direction perpendicular to the axial direction of the first roller 81; and a mounting portion 87*c* formed at the other end portion by bending in the direction perpendicular to the axial direction of the first roller 81.

The base portion 87*a* is provided with three holes 87*d* through which screws 89 are inserted. The mounting portion 87*b* is provided with a hole 87*e* into which the pin 72 attached to the frame 71 is fitted; a pin 87*f* locked to the locking portion of the locking mechanism 90; and a square hole 87*g* used for position adjustment of the first roller 81.

The mounting portion 87*c* is provided with a screw hole 87*h* into which the mounting screw 73 is screwed; a pin 87*i* locked to the locking portion of the locking mechanism 90; and a square hole 87*j* used for position adjustment of the first roller 81.

The first support members 84 and 85 are each fixed to the second support member 86 by the two screws 88 in a state where the hole 84*e* of the first support member 84 is retrofitted to one end portion of the first roller 81 via the bearing 83 and the hole 85*e* of the first support member 85 is retrofitted to the other end portion of the first roller 81 via the bearing 83.

When fastening the screws 88, by making the two notch portions 84*d* of the first support member 84 and the two notch portions 86*d* of the second support member 86 flush with each other using a jig or the like, assembly accuracy between the first support member 84 and the second support member 86 can be improved. The same applies to the first support member 85 as well.

The reason why the first support member 84 and the first support member 85 are provided as separate parts is to incorporate the first roller 81 into the roller unit 80 while achieving a configuration for restricting the movement of the first roller 81 in the axial direction by using the flanges of the bearing 83. That is, the bearing 83 is assembled to the roller unit 80 such that the flanges are positioned between the first support member 84 and the first support member 85.

However, various known structures can be adopted as the structure for restricting the movement of the first roller 81 in the axial direction. If the first roller 81 can be incorporated into the roller unit 80, the first support member 84 and the first support member 85 may be integrally formed.

The second support member 86 to which the first roller 81 and the like are attached is fixed to the mounting member 87 with three screws 89.

As shown in FIG. 5, the three holes 87*d* of the base portion 87*a* are long holes extending in a front-rear direction. Therefore, when fastening the screws 89, the position of the second support member 86, that is, the position of the first roller 81 can be adjusted in the front-rear direction.

As described above, the mounting portion 87*b* is provided with the square hole 87*g*, and the mounting portion 87*c* is provided with the square hole 87*j*. The square holes 87*g* and 87*j* have a square shape with a width in the front-rear direction larger than a diameter of the end portion of the first roller 81. Therefore, as shown in FIG. 7, when the roller unit 80 is viewed from the axial direction of the first roller 81, the positions of the end portions of the first roller 81 can be confirmed through the square hole 87*j* (87*g*).

Since the bearing 83 is retrofitted to the first roller 81, inner circumference and outer circumference of an inner ring 83*a* of the bearing 83 and inner circumference and outer circumference of an outer ring 83*b* of the bearing 83 are visually recognized as a quadruple circle coaxial with the first roller 81. Therefore, in the roller unit 80 of the present embodiment, when fastening the three screws 89, the position of the first roller 81 can be adjusted in the front-rear direction while confirming how the quadruple circle formed by the bearing 83 looks through the square holes 87*g* and 87*j*.

That is, the quadruple circle formed by the bearing 83 functions as an indicator (scale) when adjusting the position of the first roller 81.

As shown in FIGS. 6 and 7, in the roller unit 80 in the first setting, the second support member 86 supports the rear side of the first support members 84 and 85 and does not support the front side thereof. In other words, the first support members 84 and 85 are cantilever beams with fixed ends on the rear side and free ends on the front side.

As described above, when the roller unit 80 is attached to the frame 71, the first roller 81 is pressed against the second roller 82. Therefore, when the roller unit 80 is attached to the frame 71, as indicated by a solid line arrow in FIG. 7, deflection (bending) occurs in the first support members 84 and 85 that support the first roller 81. As a result, the first roller 81 and the second roller 82 nips the liner sheet 21 by a deflection reaction force of the first support members 84 and 85. That is, the first support members 84 and 85 function as leaf springs.

As a result, the nipping force between the first roller 81 and the second roller 82 is determined by the deflection reaction force of the first support members 84 and 85. Therefore, it is possible to suppress variation in the nipping force due to an assembly error or the like, and it is possible to easily set the nipping force between the first roller 81 and the second roller 82 to an appropriate nipping force.

Specifically, the smaller a spring constant of the first support members 84 and 85, the smaller the variation in the deflection reaction force of the first support members 84 and 85 due to an assembly error or the like. Therefore, by reducing the spring constant of the first support members 84 and 85 to such an extent that the variation in the deflection reaction force can be tolerated, the nipping force between the first roller 81 and the second roller 82 can be stably generated as intended.

Next, the roller unit 80 in the second setting will be described.

Figure 8:
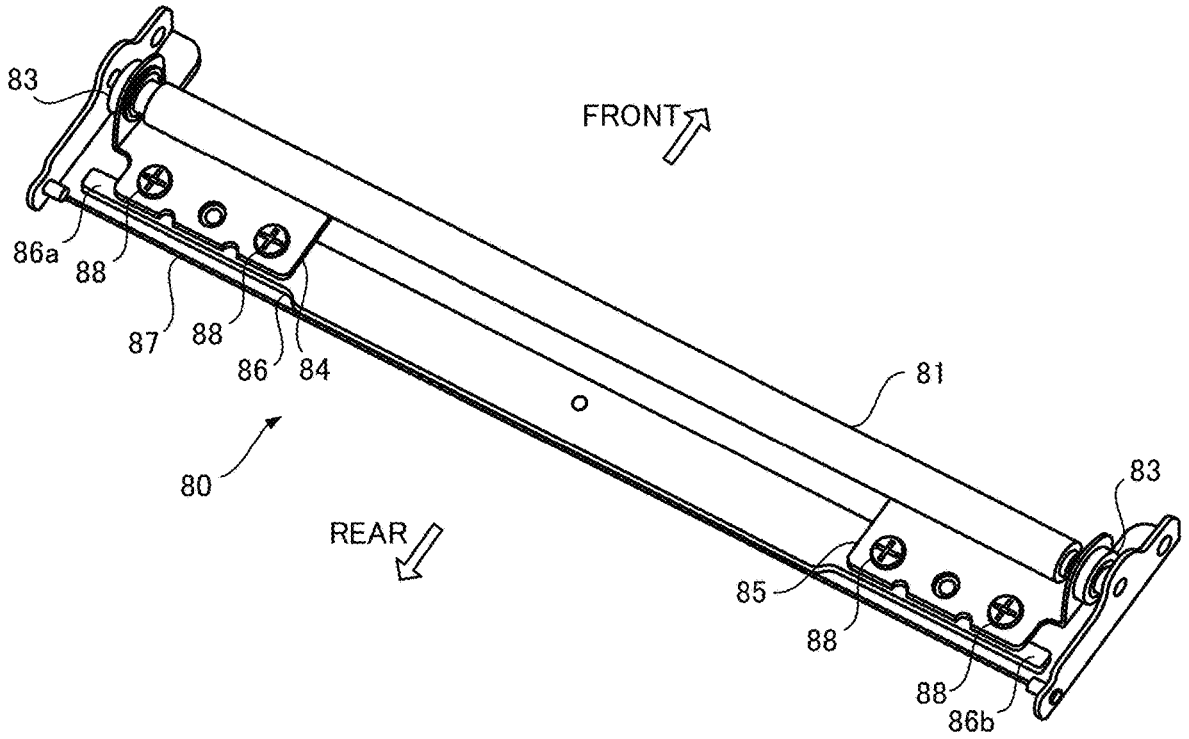
FIG. 8 is a perspective view of the roller unit in a second setting.

FIG. 8 is a perspective view of the roller unit 80 in the second setting. As shown in FIG. 8, the roller unit 80 in the second setting differs from the roller unit 80 in the first setting in the assembly state of the second support member 86.

Specifically, in the second setting, the second support member 86 is assembled to the roller unit 80 so that the protruding portions 86*a* and 86*b* are positioned on the rear side.

In the roller unit 80 in the first setting, as shown in FIGS. 6 and 7, the protruding portions 86*a* and 86*b* are positioned to support the roller support portions 84*b* and 85*b* of the first support members 84 and 85. On the other hand, in the roller unit 80 in the second setting, as shown in FIG. 8, the protruding portions 86*a* and 86*b* are positioned not to support the roller support portions 84*b* and 85*b* of the first support members 84 and 85.

Since the position of the first roller 81 does not change between the roller unit 80 in the first setting and the roller unit 80 in the second setting, there is no change in a load input point (position) to the free ends of the first support members 84 and 85 as cantilevers. On the other hand, in the roller unit 80 in the second setting, the fixed ends of the first support members 84 and 85 are positioned farther from the load input point than in the roller unit 80 in the first setting.

It means that the spring constant of the first support members 84 and 85 as leaf springs in the roller unit 80 in the second setting is smaller than the spring constant of the first support members 84 and 85 in the roller unit 80 in the first setting.

Therefore, in the feed roller mechanism 70 in the assembly state (second assembly state) in which the roller unit 80 is in the second setting, the nipping force between the first roller 81 and the second roller 82 can be set to a nipping force (predetermined second nipping force) smaller than the nipping force (predetermined first nipping force) of the feed roller mechanism 70 in the assembly state (first assembly state) in which the roller unit 80 is in the first setting. In the feed roller mechanism 70 in the second assembly state, similarly to the feed roller mechanism 70 in the first assembly state, the nipping force can be stably generated as intended.

The nipping force can also be changed by adjusting the position of the first roller 81. However, since a position adjustment range of the first roller 81 is limited by the holes 87*d*, the nipping force cannot be greatly changed. On the other hand, when the assembly state of the feed roller mechanism 70 is changed from the first assembly state to the second assembly state, the nipping force can be made smaller beyond the range of change in the nipping force due to position adjustment of the first roller 81.

As described above, the printer 1 of the present embodiment may print on the label continuous body 17 including the liner sheet 21 on which the perforations 17*a* are formed at a predetermined interval. When the liner sheet 21 is formed with the perforations 17*a*, it is more likely to break than when it is not formed with the perforations 17*a*. Therefore, by setting the feed roller mechanism 70 in the second assembly state to facilitate the occurrence of slippage between the first roller 81 and the second roller 82 and the liner sheet 21 to some extent, it is possible to suppress breakage due to a large tension applied to the liner sheet 21 being fed, and breakage due to stress concentration caused by distortion occurring in the liner sheet 21.

When the liner sheet 21 is not formed with the perforations 17*a*, by setting the feed roller mechanism 70 in the first assembly state and setting the nipping force between the first roller 81 and the second roller 82 to the predetermined first nipping force, more stable feeding can be achieved.

Whether the feed roller mechanism 70 is in the first assembly state or the second assembly state can be appropriately selected by the user according to the continuous paper to be fed. Therefore, when the continuous paper is formed with perforations, the feed roller mechanism 70 may be set in the first assembly state, and when the continuous paper is not formed with perforations, the feed roller mechanism 70 may be set in the second assembly state.

Main functions and effects of the feed roller mechanism 70 and the printer 1 configured as described above will be collectively described.

The feed roller mechanism 70 that feeds the liner sheet 21 while nipping the liner sheet 21 between the first roller 81 and the second roller 82 facing each other includes the plate-shaped first support members 84 and 85 that support the first roller 81; and the plate-shaped second support member 86 that supports the first support members 84 and 85. The first roller 81 and the second roller 82 nips the liner sheet 21 by the deflection reaction force of the first support members 84 and 85.

As a result, the nipping force between the first roller 81 and the second roller 82 is determined by the deflection reaction force of the first support members 84 and 85. Therefore, it is possible to suppress variation in the nipping force due to an assembly error or the like, and it is possible to easily set the nipping force between the first roller 81 and the second roller 82 to an appropriate nipping force.

The first support members 84 and 85 support the first roller 81 with the roller support portions 84*b* and 85*b* formed by bending in the direction perpendicular to the axial direction of the first roller 81.

Accordingly, the structure which supports the first roller 81 can be easily achieved by manufacturing the first support members 84 and 85 by press molding.

The feed roller mechanism 70 is capable of changing between the first assembly state in which the second support member 86 supports the roller support portions 84*b* and 85*b* of the first support members 84 and 85, and the second assembly state in which the second support member 86 does not support the roller support portions 84*b* and 85*b* of the first support members 84 and 85.

Accordingly, by setting the feed roller mechanism 70 to the second assembly state, the nipping force between the first roller 81 and the second roller 82 can be made smaller than when the feed roller mechanism 70 is set to the first assembly state. That is, the nipping force between the first roller 81 and the second roller 82 can be selected between the predetermined first nipping force and the predetermined second nipping force according to the continuous paper to be fed.

The second support member 86 includes the protruding portions 86*a* and 86*b* that are provided at the end portions in the axial direction of the first roller 81 and protrude in the axial direction of the first roller 81. In the first assembly state, the protruding portions 86*a* and 86*b* support the roller support portions 84*b* and 85*b* of the first support members 84 and 85, and in the second assembly state, the protruding portions 86*a* and 86*b* do not support the roller support portions 84*b* and 85*b* of the first support members 84 and 85.

Accordingly, it is possible to achieve a configuration of being capable of changing between the predetermined first nipping force and the predetermined second nipping force merely by providing the protruding portions 86*a* and 86*b* on the second support member 86. That is, it is possible to achieve a configuration of being capable of changing between the predetermined first nipping force and the predetermined second nipping force without increasing the number of component parts and cost.

The second support member 86 includes the plurality of screw holes 86*c* into which the screws 88 for fixing the first support members 84 and 85 to the second support member 86 are screwed, and the plurality of screw holes 86*c* are aligned on the straight line L, and the positions of the protruding portions 86*a* and 86*b* are offset with respect to the straight line L.

Accordingly, the first assembly state and the second assembly state can be changed by a simple operation of merely changing the inside and outside or front side and rear side of the second support member 86.

The first support members 84 and 85 are leaf springs.

Accordingly, strength and durability of the first support members 84 and 85 can be ensured.

The liner sheet 21 may include the perforations 17*a* formed at a predetermined interval.

Even when the liner sheet 21 includes the perforations 17*a*, by setting the feed roller mechanism 70 in the second assembly state to facilitate the occurrence of slippage between the first roller 81 and the second roller 82 and the liner sheet 21 to some extent, it is possible to suppress breakage due to a large tension applied to the liner sheet 21 being fed, and breakage due to stress concentration caused by distortion occurring in the liner sheet 21.

The printer 1 includes the feed roller mechanism 70.

Accordingly, in the printer 1, the nipping force between the two rollers that feed the continuous paper can be easily set to an appropriate nipping force.

While an embodiment of the invention has been described, the embodiment is merely one of application examples of the invention, and does not intend to limit a technical scope of the invention to a specific configuration according to the embodiment.

For example, in the above embodiment, the printer 1 including the feed roller mechanism 70 is described. However, the feed roller mechanism according to the present invention can be incorporated into various devices and facilities. Any configuration can be selected as appropriate for the configuration for attaching the feed roller mechanism to various devices and facilities.

In the above-described embodiment, the notch portion 86*d* of the second support member 86 is provided on one side edge (the side edge on the rear side in FIG. 5). However, the other side edge (the side edge on the rear side in FIG. 5) may also be provided with a notch portion. Accordingly, even in the roller unit 80 in the second setting, the assembly accuracy of the first support members 84 and 85 and the second support member 86 can be improved.

In the above-described embodiment, the quadruple circle formed by the bearing 83 is used as an indicator when adjusting the position of the first roller 81. However, a component functioning as an indicator may be provided separately, or an indicator may be formed on an end surface of the first roller 81. The number of multiple circles as an indicator may be three or less, or may be five or more.

Further, in the above embodiment, the first support members 84 and 85, the second support member 86, and the mounting member 87 are made of metal. However, the first support members 84 and 85, the second support member 86, and the mounting member 87 may be made of materials other than metal, and may be made of synthetic resin, for example.

In the above embodiment, when the roller unit 80 is set to the first setting, the protruding portions 86*a* and 86*b* are positioned to support the roller support portions 84*b* and 85*b* of the first support members 84 and 85. However, the shape of the second support member 86 and the position at which the second support member 86 supports the first support members 84 and 85 are not limited to the above aspect. For example, the second support member 86 may not support the roller support portions 84*b* and 85*b* regardless of whether the roller unit 80 is set to the first setting or the second setting. That is, the second support member 86 can adopt various shapes that can change the spring constant of the first support members 84 and 85 as leaf springs by changing the assembly state.

In the above embodiment, the first support members 84 and 85 are each fixed to the second support member 86 by the two screws 88, and the second support member 86 is fixed to the mounting member 87 by the three screws 89. However, the number of the screws 88 and 89 can be changed as appropriate.

The present application makes a priority claim based on Japanese Patent Application No. 2021-91670 filed in the Japan Patent Office on May 31, 2021, and the entire disclosure of this application is incorporated herein by reference.

The invention claimed is:

1. A feed roller mechanism configured to feed a continuous paper while nipping the continuous paper between a first roller and a second roller that face each other, the feed roller mechanism comprising:

a first support member that comprises a roller support portion configured to support the first roller; and a plate-shaped second support member that supports the first support member, wherein:

the first roller is configured to nip the continuous paper with the second roller by a deflection reaction force of the first support member, and the feed roller mechanism is changeable between a first assembly state in which the second support member supports the roller support portion of the first support member, and a second assembly state in which the second support member does not support the roller support portion of the first support member.

2. The feed roller mechanism according to claim 1, wherein:

the second support member comprises a protruding portion provided at an end portion in the axial direction of the first roller and protruding in the axial direction of the first roller, in the first assembly state, the protruding portion supports the roller support portion of the first support member, and in the second assembly state, the protruding portion does not support the roller support portion of the first support member.

3. The feed roller mechanism according to claim 2, wherein:

the second support member has a plurality of screw holes into which screws that fix the first support member to the second support member are screwed, the plurality of screw holes are arranged in a straight line, and a position of the protruding portion is offset with respect to the straight line.

4. The feed roller mechanism according to claim 1, wherein:

the first support member is a leaf spring.

5. A printer comprising the feed roller mechanism according to claim 1.

6. The feed roller mechanism according to claim 1, wherein:

the first support member comprises a base member, and the roller support portion extends from the base member in a direction perpendicular to an axial direction of the first roller.

* * * * *